US005509531A

United States Patent [19]

Patrick et al.

[11] Patent Number: 5,509,531

[45] Date of Patent: Apr. 23, 1996

[54] GOLF BAG SECTIONING DEVICE

[76] Inventors: Timothy M. Patrick; Steven Aungst, both of 386 Palos Verdes Blvd., S. Redondo Beach, Calif. 90277

[21] Appl. No.: 372,929

[22] Filed: Jan. 17, 1995

[51] Int. Cl.[6] ..... A63B 55/00

[52] U.S. Cl. ..... 206/315.6; 24/563; 211/70.2

[58] Field of Search ..... 266/315.6, 315.3; 190/109, 110, 111; 206/292; 220/551, 528; 24/545, 555, 563; 211/70.2

[56] References Cited

U.S. PATENT DOCUMENTS

| | | | |
|---|---|---|---|
| 1,780,802 | 11/1930 | Sutcliffe | 206/315.6 |
| 1,913,021 | 6/1933 | Butterick | 206/292 |
| 2,161,624 | 6/1939 | Hoerr | 220/551 |
| 2,184,569 | 12/1939 | Stewart | 24/555 |
| 2,436,687 | 2/1948 | Corbett | 206/315.6 |
| 3,503,518 | 3/1970 | Black | 211/70.2 |
| 4,130,153 | 12/1978 | Zopf | 206/315.6 |
| 4,155,387 | 5/1979 | Costa | 206/315.6 |
| 4,635,793 | 1/1987 | Kim | 206/315.6 |
| 4,886,228 | 12/1989 | Kennedy | 24/545 X |
| 4,955,472 | 9/1990 | Yamazoe | 206/315.6 |
| 5,190,183 | 3/1993 | McNaughton et al. | 220/551 |

FOREIGN PATENT DOCUMENTS

| | | | |
|---|---|---|---|
| 398212 | 8/1933 | United Kingdom | 206/315.6 |

*Primary Examiner*—Allan N. Shoap
*Assistant Examiner*—Christopher J. McDonald

[57] ABSTRACT

A golf bag sectioning device wherein respective first and second tubes have respective telescoping legs extensible and retractable therefrom in a spring-biased relationship to extend the telescoping legs relative to the tubes, wherein a first clamp member is secured to the tubes, with a second clamp member secured to the telescoping legs, the clamp members are arranged to engage the rim portion of a golf bag, and when thusly positioned within the entrance opening of the golf bag, the golf bag is divided and compartmentalized relative to the entrance opening to accommodate golf clubs and the like directed through the entrance opening of the golf bag.

5 Claims, 4 Drawing Sheets

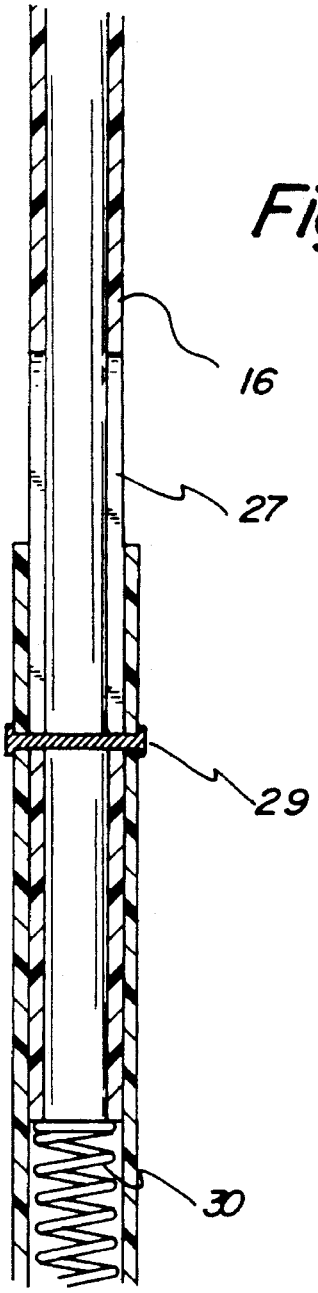
Fig. 7
Fig. 8
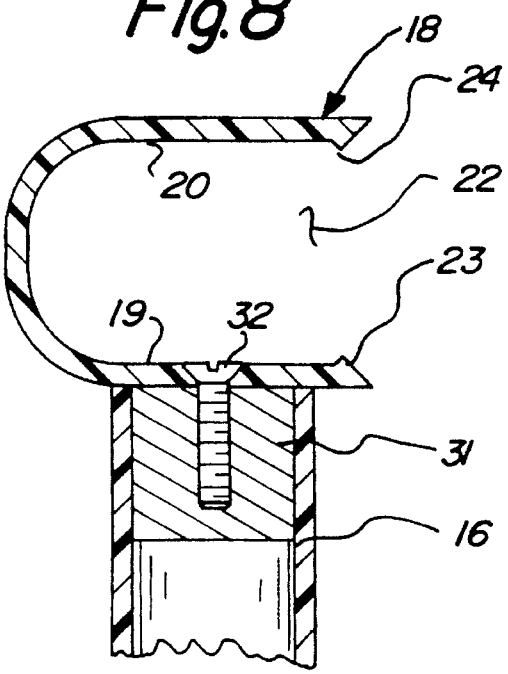

GOLF BAG SECTIONING DEVICE

TECHNICAL FIELD

The field of invention relates to golf bag sectioning structure, and more particularly to a golf bag sectioning device wherein the same is arranged to compartmentalize a golf bag with a minimum effort permitting retrofit of the device relative to the golf bag structure.

BACKGROUND OF THE INVENTION

Golf bag sectioning and organizer structure has been available in the prior art as exemplified by the U.S. Pat No. 4,181,167 of unitary construction Similarly, U.S. Pat Nos. 5,094,345; 5,255,781; as well as accessory structures US Pat Nos 4,804,121 and 5,269,410 have been employed in the golfing sport.

The prior art has heretofore failed to indicate the utilization of a readily snap-fit, retrofit structure as employed by the invention setting forth advantages over the prior art not having been available hereto in the retrofit and compartmentalizing of a golf bag member.

SUMMARY OF THE INVENTION

The golf bag sectioning device of the invention includes spaced tube members, each having respective telescoping legs extending therefrom in a spring-biased projecting relationship, such that the tube members have a first clamp member and the telescoping legs have a second clamp member that are of themselves arranged for clamping securement to an upper perimeter rim of a golf bag that when thusly secured section the entrance of the golf bag and the sectioning of golf clubs and the like extending therethrough.

Objects and advantages of this invention will become apparent from the following description taken in conjunction with the accompanying drawings wherein are set forth, by way of illustration and example, certain embodiments of his invention.

The drawings constitute a part of this specification and include exemplary embodiments of the present invention and illustrate various objects and features thereof.

BRIEF DESCRIPTION OF THE DRAWINGS

FIG 7 is an orthographic view, taken along the lines 7—7 of FIG 5 in the direction indicated by the arrows.

FIG 8 is an orthographic view, taken along the lines 8—8 of FIG 5 in the direction indicated by the arrows.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
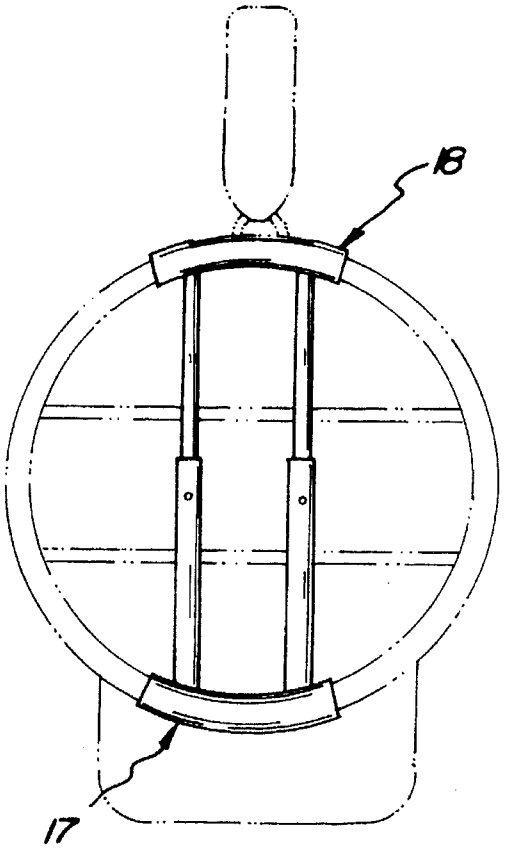
FIG 3 is an orthographic top view of the invention in a secured orientation relative to the entrance rim of the golf club bag.
Figure 5:
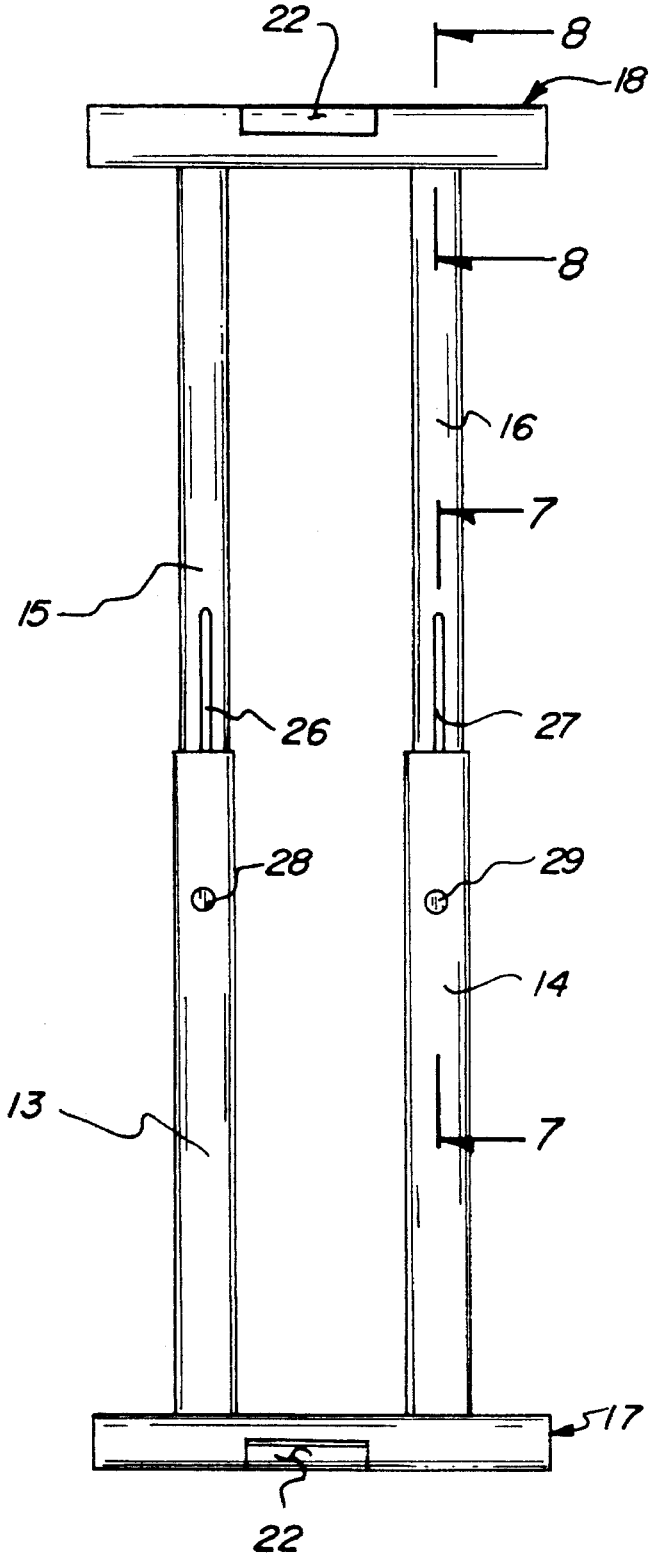
FIG 5 is an orthographic top view of the invention in an enlarged illustration.
Figure 6:
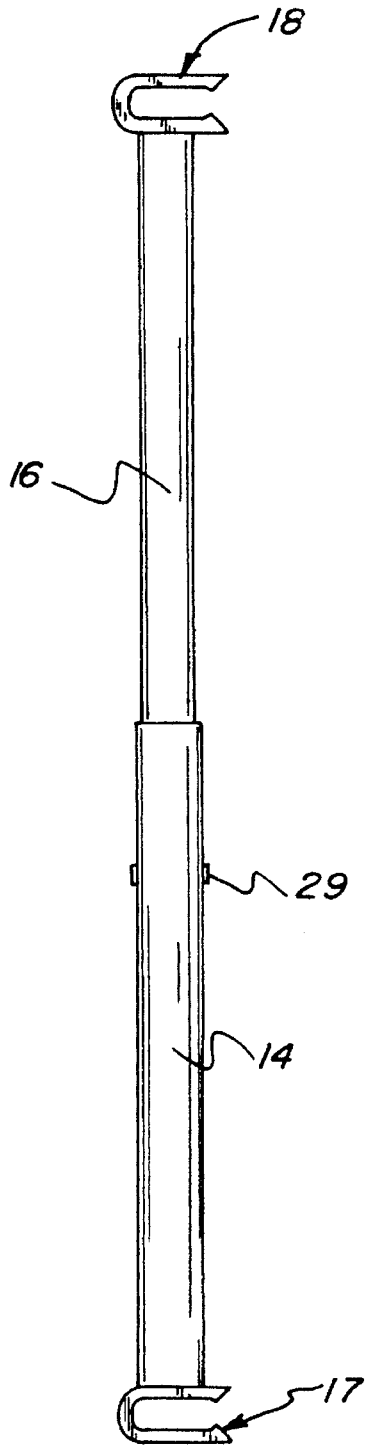
FIG 6 is an orthographic side view of the invention.

The golf bag sectioning device 10 of the invention is constructed with an entrance rim 11 of conventional construction and as illustrated, having a strap member extending therefrom The device 10 employs respective first and second tubes 13 and 14 indicated in a spaced parallel relationship, with the first tube 13 having a first telescoping leg 15 extensible therefrom, wherein the telescoping leg 18 is extensible relative to the second tube 14. A first U-shaped clamp 18 is fixedly mounted to the first tube 13 and the second tube 14, with a second U-shaped clamp 18 fixedly secured to the first telescoping leg 15 and the second telescoping leg 16. It should be noted the first and second U-shaped clamps are of a flexible nature to accommodate the configuration of the golf bag entrance rim 11. The flexible nature should be such that a typical shape retentive material is employed for assistance in grasping the rim when secured thereto, as indicated in FIG 3.

Figure 2:
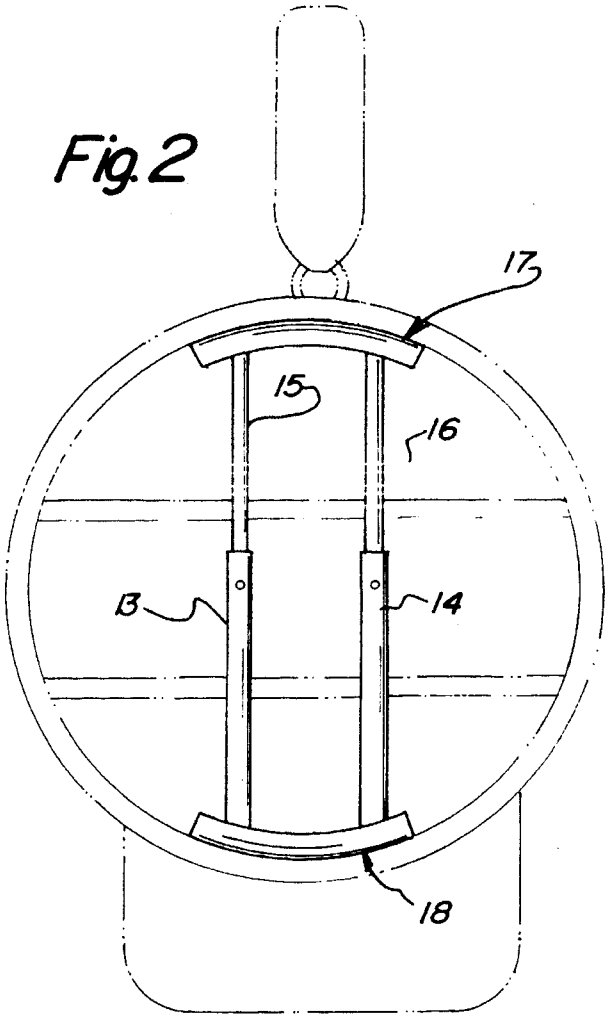
FIG 2 is an orthographic top view of the invention positioned within a golf club bag.
Figure 1:
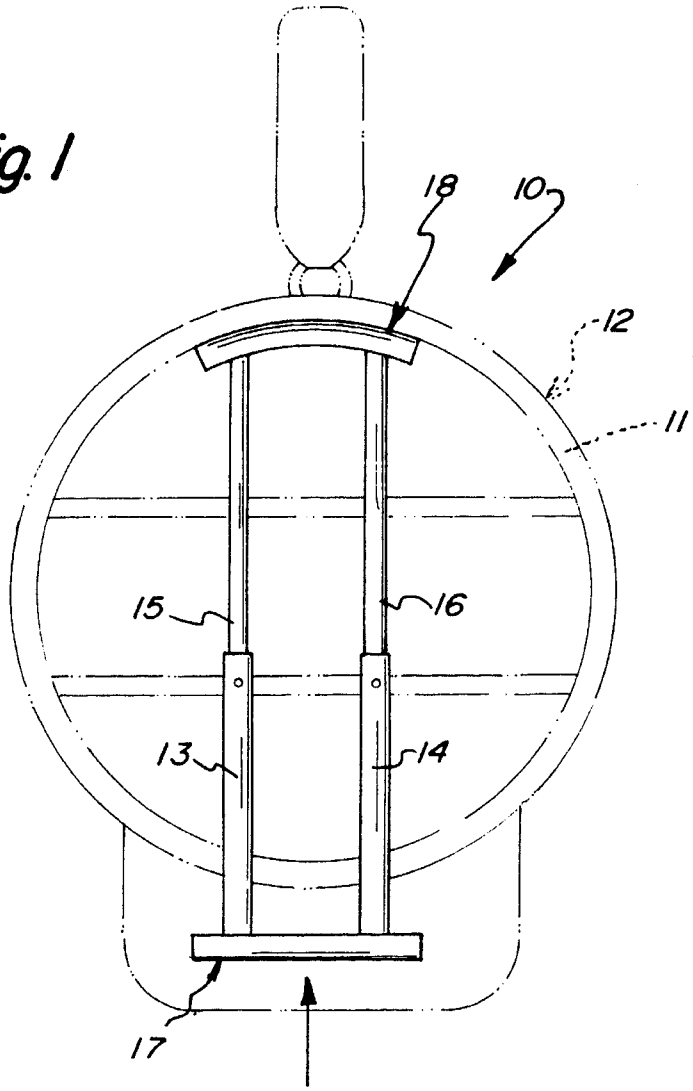
FIG 1 is an orthographic top view of the invention.
Figure 4:
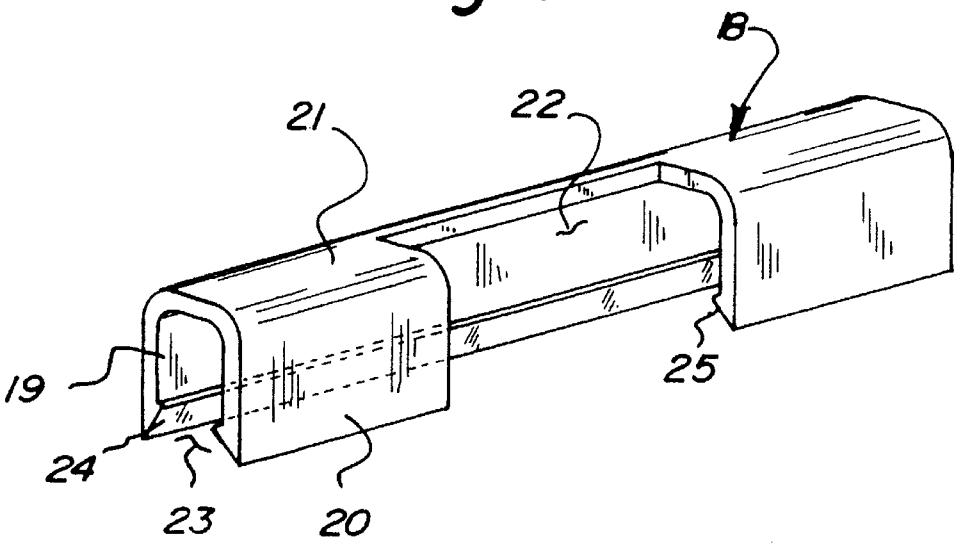
FIG 4 is an isometric illustration of a representative clamp structure as employed by the invention.

Each of the clamps 17 and 18 are configured in a manner as illustrated in FIG 4, wherein a first web 19 is spaced from a second web 20 that is in itself discontinuous, with a connecting web 21 connecting the first and second webs 19 and 20. A strap opening 22 extends through the second web 20 into the connecting web 21 to permit a strap member to be directed therethrough when the clamp structure is secured to the rim 11. In this manner, a clamping channel 23 receives and secures the rim 11 therewithin. Further, to assist in the clamping a first web projection 24 extends along the lower periphery and free end of the first web 19, where similarly a second web projection 25 extends along the discontinuous second web 20 to engage and clamp the golf bag 12 typically below the rim 11.

The first and second telescoping legs 15 and 16 respectively are provided with respective first and second slots 26 and 27, such as exemplified in the FIG. 7 A first and second abutment rod 28 and 29 respectively fixedly secured to the respective first and second tubes 13 and 14 are received within the first and second slots 26 and 27 to permit guided sliding, with a spring member 30 positioned within each of the tubes 13 and 14 to engage a respective telescoping leg within that tube to effect projection of the telescoping leg relative to the tube structure.

To assist in the flexibility of the first and second clamps 17 and 18 (see FIG. 8), a resilient plug 31 is positioned into each telescoping leg at its free distal end, such that a fastener 32 is directed through a respective first web 19 of the clamp structure. In this manner, the flexibility of the clamp relative to the leg structure is provided Similarly, a similar resilient plug is mounted to each of the first and second tubes in securing the first clamp 17 in a like manner, as illustrated in FIG. 8, where for purposes of illustration indicates identical construction relative to the resilient plug structure relative to an associated mounting of the clamp.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A golf bag sectioning device, comprising, a first tube paced from a second tube, the first tube having a first telescoping leg extensible and retractable therefrom, with the second tube having a second telescoping leg extensible and retractable therefrom, a first clamp member is secured to the first tube and to the second tube, with a second clamp member secured to the first telescoping leg and the second telescoping leg, wherein the first clamp member and the second clamp member are arranged for securement to an entrance rim of a golf bag, wherein the first clamp member and the second clamp member each have a first web spaced from a second discontinuous web, with a connecting web securing the first web and the second web together, wherein the first clamp member and the second clamp member are each provided with a clamping channel for receiving the entrance rim of the golf bag.

2. A device as set forth in claim 1 wherein the first web includes a first web projection and the second web includes a second web projection, wherein the first web projection and the second web projection are arranged in a facing relationship relative to one another within the clamping channel, and wherein the discontinuous web includes a strap opening extending therethrough, with the strap opening extending into the connecting web for receiving a strap member of the golf bag through the strap opening.

3. A device as set forth in claim 2 herein the first tube includes a first slot member directed therethrough, and the second tube having a second slot member directed therethrough, the first tube having a first abutment rod fixedly secured to the first tube, the Second tube having a second abutment rod fixedly secured to the second tube, with the first abutment rod slidably received within the first slot and the second abutment rod slidably received within the second slot.

4. A device as set forth in claim 3 wherein at least the second tube includes a spring member contained therewithin, and the spring member in engagement with the second telescoping leg within the first tube to project the second telescoping leg relative to the second tube.

5. A device as set forth in claim 4 wherein at least said second telescoping tube further includes a resilient plug, and the resilient plug having a fastener directed through the first web of the first clamp member to secure the first clamp member to the second telescoping leg.

* * * * *